US006438242B1

(12) United States Patent
Howarth

(10) Patent No.: US 6,438,242 B1
(45) Date of Patent: Aug. 20, 2002

(54) ACOUSTIC TRANSDUCER PANEL

(75) Inventor: Thomas R. Howarth, Owings, MD (US)

(73) Assignee: The United States of America as represented by the Secretary of Navy, Washington, DC (US)

( * ) Notice: Subject to any disclaimer, the term of this patent is extended or adjusted under 35 U.S.C. 154(b) by 0 days.

(21) Appl. No.: 09/404,721

(22) Filed: Sep. 7, 1999

(51) Int. Cl.[7] ..... H04R 25/10

(52) U.S. Cl. ..... 381/190; 310/324; 310/800; 181/161; 181/149; 381/162; 381/173; 381/191

(58) Field of Search ..... 381/162, 163, 381/173, 191, 431, 339, 190; 181/161, 149; 310/324, 800

(56) References Cited

U.S. PATENT DOCUMENTS 3,947,644 A * 3/1976 Uchikawa
4,112,168 A * 9/1978 Schafft
4,186,323 A * 1/1980 Cragg
4,751,419 A * 6/1988 Takahata ..... 310/322
4,845,688 A * 7/1989 Butler
4,999,819 A * 3/1991 Newnham
5,025,474 A * 6/1991 Tanaka ..... 181/148
5,185,549 A * 2/1993 Sullivan
5,196,755 A * 3/1993 Shields ..... 310/322
5,276,657 A * 1/1994 Newnham
5,640,961 A * 6/1997 Verdonk
5,802,195 A * 9/1998 Regan
5,838,805 A * 11/1998 Warnaka ..... 310/322
6,232,702 B1 * 5/2001 Newnham

* cited by examiner

*Primary Examiner*—Huyen Le
*Assistant Examiner*—Dionne Harvey
(74) *Attorney, Agent, or Firm*—John J. Karasek; John Gladstone Mills, III

(57) ABSTRACT

An electro-acoustic transducer in which a plurality of cymbal-type electro-acoustic actuators are disposed in mechanical and electrical parallel between a pair of stiff plates. The resultant transducer resonates at a lower frequency than the cymbals, with a greater generated force.

6 Claims, 2 Drawing Sheets

ACOUSTIC TRANSDUCER PANEL

BACKGROUND OF THE INVENTION

Low frequency transducers having resonances below about 1 kHz have numerous applications, one of which is as a low frequency sonar projector. This acoustic wavelength corresponding to these frequencies is on the order of the size of naval mines, and thus can hunt for and/or classify them, as well as objects of similar size. Also, wavelengths of this size permit sonar location of buried objects, a task of interest to a wide range of commercial and governmental concerns. Unfortunately, current underwater projectors at these frequencies are large and heavy, and are cumbersome to use on many underwater vehicles.

Another application for low frequency transducers is that of active noise control. Essentially, there are two schemes by which to control unwanted sound and vibration. One, passive, adds additional mass, stiffness, or damping; the other, active, uses destructive interference of the sound or vibration field. Passive control techniques are best suited for applications where the frequency band of the disturbance is above 1 kHz. On the other hand, active control has found use in applications where the frequency range of interest is between 50 Hz and 1 kHz. The use of adaptive and smart structures for the active control of vibrations is based on the successful combination of sensor, actuator, and electronic control systems. Active control structures can eliminate structural vibrations from, e.g., a piece of manufacturing equipment or a helicopter rotor, remarkably improving the lifetime of each by reducing wear. Likewise, minimizing cabin noise in an aircraft or duct noise in a building leads to a much higher comfort level for the people in side. In active control, a sensor/actuator combination which is located on the surface of the vibrating structure is used to detect and suppress the disturbance. The vibration signal picked up by the sensor is sent to the appropriate electronic circuitry and is subsequently used to drive the actuator such that it has the same magnitude but opposite phase (or opposite time delay) as the disturbance.

Current state of the art in active vibration control is that the sensor and electronic control systems are more technologically advanced than the actuator components. Control systems have benefitted from faster and cheaper microelectronics available from the computer industry. Likewise, a wide variety of sensors have been developed including fiber optic, piezocomposite accelerometers, and acoustic pressure sensors. Sensor selections can now be based on application specific needs. This means that the weakest link in active control systems is in actuator technology.

In systems aiming to cancel structure-borne sound, a pressing need is for an actuator panel whose bandwidth contains about 50 Hz to 1 kHz, and has a linear near-field velocity (displacement) profile coupled with high force capability. An additional consideration is for the actuators to be rugged enough for placement in applications where they may be leaned on or pushed against without damage. Because many active control systems are in environments where they are placed in large sheets (panels), such as in large vibrating machinery mounts in power plants, an actuator must be physically rugged enough to withstand normal forces and hazardous exposures.

Many active control systems utilize either hydraulics or large, heavy electro-magnetic force transducers as the actuator component. These technologies may often be constrained by packaging limitations as well as high cost. In recent years, piezoelectric materials either in the form of piezoceramic-polymer composites, multilayer stacks, or flexor-type configurations have been studied for active vibration control applications. Multilayer stacks and piezoceramic-polymer composites are characterized as generating high force/low displacement, whereas the flexors exhibit low force/high displacement capabilities.

Another type of actuator, called the "cymbal," effectively bridges the gap between the high force/low displacement multilayer stacks and the low force/high displacement flexors. Cymbal actuators show excellent potential for many active vibration control applications because they are simple to manufacture (resulting in low cost), exhibit thin profile, ruggedness, adaptability to panel form, and tailorable device characteristics.

SUMMARY OF THE INVENTION

Accordingly, an object of the invention is to reduce the cost of active electro-acoustic transducers by use of inherently inexpensive cymbal-type actuators.

Another object is to enable such a transducer to operate at lower frequencies, particularly between 50 Hz and 1 kHz.

Another object is to do the foregoing with a transducer that is inherently rugged.

Another object is to do the foregoing with a transducer whose near field velocity is substantially linear.

Another object is to do the foregoing in a manner which permits a designer to tailor the trade off inherent in acoustic transducers between transducer force and displacement.

Another object is to provide an acoustic projector operating at 1 kHz or less that is small, lightweight, and has low vehicle volume occupation.

In accordance with these and other objects made apparent hereinafter, the invention concerns an electro-acoustic transducer having a plurality of cymbal-type acoustic elements; and a pair of plates containing the cymbals such that the cymbals are disposed in mechanical and electrical parallel arrangements between the plates. It has found that, when driven in piston mode, i.e., at or below the transducer's fundamental, or piston, mode, the cymbals are mechanically reactive (i.e., they are moving in-phase with each other) such that they move together as a unit. This results in an overall system of greater inertia, and hence lower resonant frequency and corresponding lower frequency band of operation. Further, because the magnitude of acoustic output depends on the number of actuators, this structure inherently produces more force than individual actuators, making total force output a matter of design choice. This, coupled with apriori knowledge of the design of individual cymbal actuators, permits tailoring of the panel's force-displacement tradeoff to specific design needs. Because operation is in the piston-mode, the transducer is void of higher order plate modes, and motion of the panel is up and down in a linear fashion, resulting in a linear near field velocity. The cymbal-panel design is inherently sturdy, small, and lightweight.

These and other objects are further understood from the following detailed description of particular embodiments of the invention. It is understood, however, that the invention is capable of extended application beyond the precise details of these embodiments. Changes and modifications can be made to the embodiments that do not affect the spirit of the invention, nor exceed its scope, as expressed in the appended claims. The embodiments are described with particular reference to the accompanying drawings, wherein:

DETAILED DESCRIPTION

Figure 1:
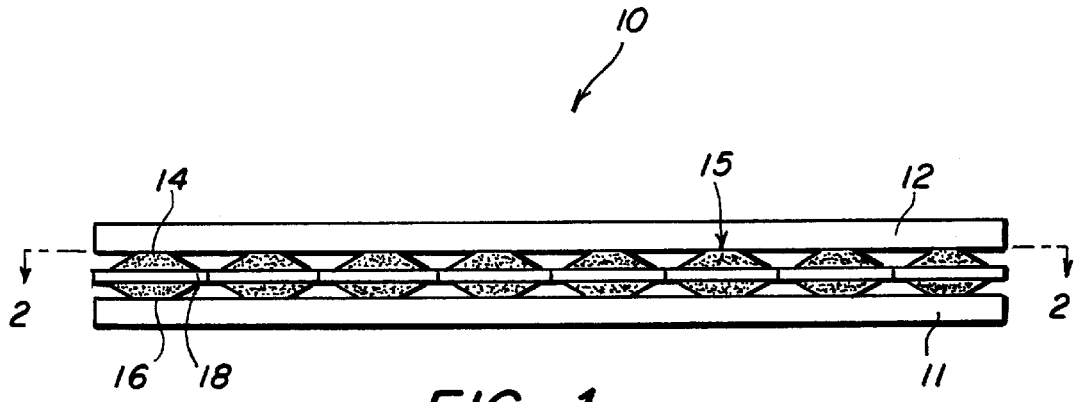
FIG. 1 is a side elevational view of a transducer according to the invention.
Figure 2:
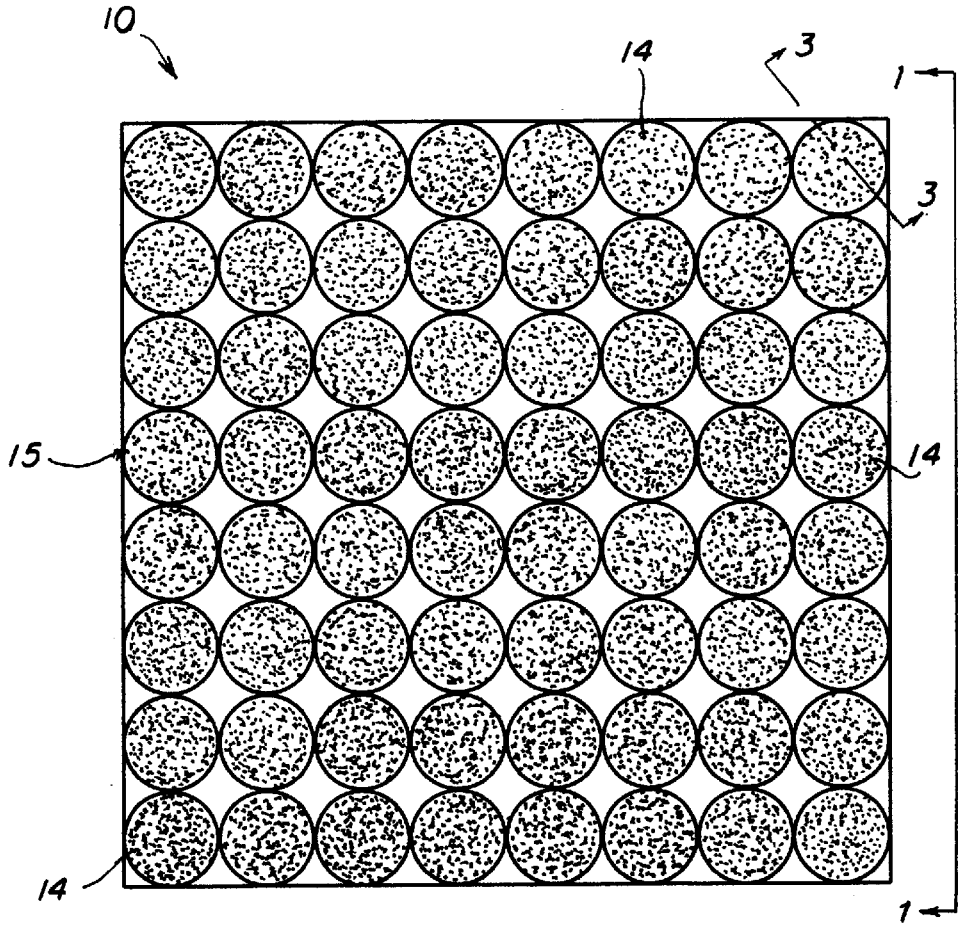
FIG. 2 is a sectional view in the direction of lines 2—2 of FIG. 1.

With reference to the drawing figures, wherein like numbers indicate like parts throughout the several views, FIGS. 1 and 2 show a transducer 10 according to the invention. Transducer 10 has a two-dimensional array of cymbal-type acoustic elements 15, of which the embodiment of FIGS. 1 and 2 show an eight by eight array. Each element 15 has top and bottom caps 14, 16, disposed about an active electro-acoustic material 18, e.g., a piezoelectric ceramic, single crystal driver, etc. Each member of the array of cymbals 15 is fixed to a pair of rigid plates 11, 12 in a mechanical parallel arrangement, and are disposed in an electrical parallel arrangement with one another (the conventional electrical connections are not shown in the drawing figures).

In operation, transducer 10 can be driven by an electrical input directed in parallel to piezo-electric ceramic 18 of each cymbal 15, resulting in a mechanical displacement in each which is transmitted to plates 11, 12. This is preferably done at a frequency below that of plate flexure, i.e., below the fundamental mode of transducer 10, which ensures that transducer 10 will operate in piston mode, that is with substantially no bowing of plates 11, 12, but rather with substantially all the mechanical energy transmitted from cymbals 15 expressing itself by up and down movements of the plates toward and away from one another (i.e., in the direction of arrows 2—2 of FIG. 1). This maximizes the force generated by plates 11, 12 responsive to input to cymbals 15. Furthermore, because of mechanical loading of cymbals 15 by plates 11, 12, the resonant frequency (here, specifically the fundamental mode of transducer 10) is lowered significantly over that of individual cymbals 15. Although the foregoing describes transducer 10 as an acoustic projector, it could as well be used as a detector, i.e., could receive an acoustic signal on plates 11, 12 whose movement would be transduced to electrical signals by cymbals 15.

Plates 11, 12 can be any acoustically rigid material, by which it is meant that the panel will undergo unibody motion at the fundamental mode of transducer 10, i.e. that the acoustic wavelength of plates 11, 12 at the fundamental mode will be much larger than any dimension of the panel. Plates can be, for example, stainless steel, or a reinforced carbon graphite composite, the former being more rigid, and the latter being lighter. Cymbals 15 can be of any known type, and can be affixed to plates 11, 12 by any conventional technique known in the art, e.g. by use of epoxy to mount plates 11, 12 to caps 14, 16 of cymbals 15; or simply by making the plates and cymbals unitary.

Figure 3:
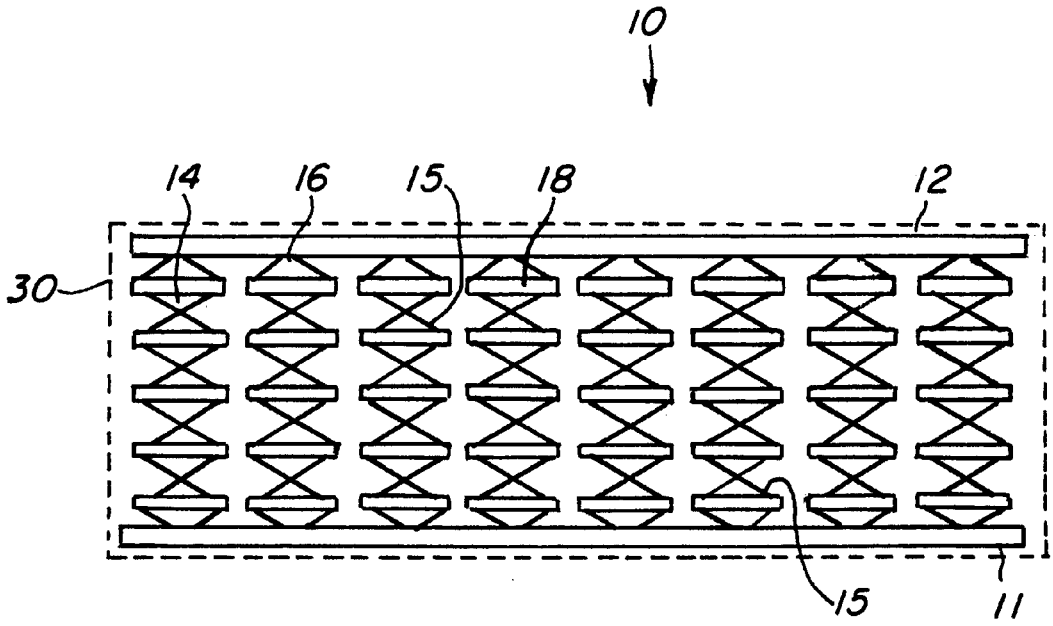
FIG. 3 is a side view of another embodiment according to the invention.

FIG. 3 shows an alternative embodiment 10', in which, in place of solitary cymbals 15 in a mechanical parallel arrangement with one another, there are a number of stacks of cymbals 15, the individual cymbals 15 in each stack being in a mechanical series arrangements with one another, and the stacks themselves being in mechanical parallel arrangements. This stacking arrangement permits higher overall transducer displacement. The number of cymbals 15 per stack in FIG. 3 is five, but this is merely exemplary.

Cymbals 15 in FIGS. 1–3 are shown close-packed; however, the spacing among cymbals 15 is design dependent, with larger spacing resulting in a lower frequency response for transducer 10, and a lower output force per unit area of plates 11, 12 corresponding to the reduced number of cymbals driving the plates. More generally, it is known how to tailor the force-displacement tradeoff of an individual cymbal by modifying the shape, thickness, or material of its caps, and by selection of its driver. In practice, the force-displacement tradeoff characteristics of individual cymbals which are arranged to form a panel such as 10 or 10' will translate into a similar force-displacement tradeoff for the panel itself Beyond this, one can further tailor panel 10''s force-displacement characteristic by disposing cymbals in mechanical parallel arrangements, as in FIGS. 1–2, or by placing the cymbals in a group of stacks, with the stacks in mechanical parallel arrangements, and cymbals within the stacks in mechanical series arrangements, as in FIG. 3. The former emphasizes higher force, the latter higher displacement. Additionally, the use of less cymbal drivers also results in higher peak panel displacement because of the larger spacing of the cymbals between the plates.

Surrounding plates 11, 12 of transducer 10' is a sealant 30, such as polyurethane, to keep water and the like out of the spaces within cymbals 15, and out of the space between plates 11, 12. This permits transducer 10' to operate underwater, e.g. in low frequency shallow water sonar applications. Illustration of sealant 30 with the embodiment of FIG. 3 is exemplary only: sealant such as 30 can be employed advantageously with the embodiments of FIGS. 1–2, or any embodiment within the scope of the invention, to permit underwater use.

EXAMPLE

Figure 4:
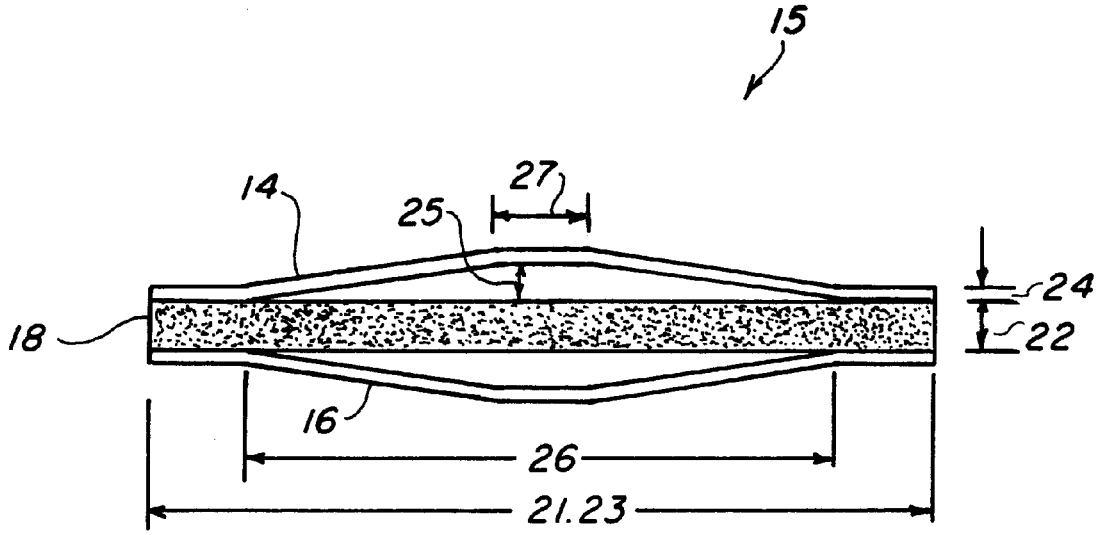
FIG. 4 is a sectional view of an individual cymbal-type transducer, viewed in the direction of lines 3—3 of FIG. 1.

Three transducers of the kind of FIGS. 1 and 2 were fabricated and tested as follows:

Cymbal fabrication. Cymbals were made using a poled piezoceramic disc (18), Department of Defense Type VI, more commonly known as PZT-5H sandwiched between and mechanically coupled to two brass caps 14, 16 (FIG. 4), each of which contains a shallow air-filled cavity on its inner surface as shown in FIG. 3. The caps convert and amplify the small radial displacement and vibration velocity of the piezoceramic disk into a much larger axial displacement and vibration velocity normal to the surface of the caps.

The caps are prepared by first cutting blank disks from a sheet of metal foil, in this case 0.20 mm thick brass. These blanks are shaped using a die press to produce the desired dimensions. The caps are then bonded to the poled PZT disk using a very thin (approximately 20 $\mu$m) layer of epoxy. Finally, the entire assembly is allowed to cure at room temperature for at least twenty-four hours while under moderate pressure.

Cymbals of two types were used, Type-1 and Type-2, differing from one another in their specific dimensions, which were:

| | Ref # | Parameter | Dimension |
|---|---|---|---|
| Type-1 | 21 | PZT diameter | 12.7 mm |
| | 22 | PZT thickness | 1.00 mm |
| | 23 | Cap diameter | 12.7 mm |
| | 24 | Cap thickness | 0.20 mm |
| | 25 | Cavity depth | 0.20 mm |
| | 26 | Base cavity diameter | 9.00 mm |
| | 27 | Apex cavity diameter | 3.00 mm |
| Type-2 | 21 | PZT diameter | 25.4 mm |
| | 22 | PZT thickness | 1.00 mm |
| | 23 | Cap diameter | 25.4 mm |
| | 24 | Cap thickness | 0.20 mm |
| | 25 | Cavity depth | 0.20 mm |
| | 26 | Base cavity diameter | 18.00 mm |
| | 27 | Apex cavity diameter | 6.00 mm |

where "Ref #" refers to reference numerals on FIG. 3, which corresponds to the dimension in the above table.

Panels. A close packed array of cymbal actuators 15 were sandwiched between two stiff cover plates for the purpose of developing a large area actuator with a uniform surface displacement/force profile. Three active actuator panel designs were investigated. Panel A had sixty-four Type-1 single element cymbals connected mechanically and electrically in parallel in an 8×8 square arrangement between two 100 mm by 100 mm by 2.275 mm thick stainless steel plates, to form a transducer 10 of the kind illustrated in FIGS. 1–2. Panels B and C were similar, only being each in a 4×4 array, and using sixteen Type-2 cymbals. Panel B had stainless steel plates of the stainless steel of the same dimensions as those of Panel B; Panel C again had plates of the same dimensions, but used carbon reinforced graphite composite, which is nearly as stiff as stainless steel, but is over five times lighter. (The carbon graphite plates were copper plated to provide an electrical contact.) In all three panel configurations, the plates are bonded to the top and bottom tips of each of the cymbal elements using silver conducting epoxy. The following table summarizes resonant frequencies $f_r$ measured for the individual cymbals, and the panel arrays.

| Element | $f_r$ |
|---|---|
| Type-1 | 18.400 kHz |
| Type-2 | 5.095 kHz |
| Panel A | 2.328 kHz |
| Panel B | 0.645 kHz |
| Panel C | 0.950 kHz |

From which one can see that the resonant frequency of each panel was substantially lower than that of the individual cymbal actuators. In particular, panels B and C were reduced in resonant frequency well within the 50 to 1000 Hz band of particular interest to active control devices, and panel A was reduced in resonant frequency to that order of magnitude. Further details of the experiment underlying this Example are given in J. F. Tressler and T. R. Howarth, Thin, Low Frequency, High Displacement Actuator Panels, *MATERIALS RESEARCH INNOVATIONS* 2, 270–277 (Springer Verlag 1999). This article is incorporated herein by referenced for all purposes.

The invention has been described in what is considered to be the most practical and preferred embodiments. It is recognized, however, that obvious modifications to these embodiments may occur to those with skill in this art. Accordingly, the scope of the invention is to be discerned from reference to the appended claims, wherein:

I claim:

1. An electro-acoustic transducer for transducing acoustic signals at or below a pre-selected acoustic frequency, comprising:

a plurality of cymbal-shaped acoustic elements; and a pair of plates;

wherein each of said plurality of cymbal-shaped acoustic elements is disposed in mechanical parallel arrangements between said pair of plates, and each of said elements is further disposed in electric parallel arrangements with respect to one another; and wherein the size of each of said pair of plates and the number of said elements is selected to be driven in piston mode by said plurality of cymbal-shaped acoustic elements at or below said pre-selected frequency.

2. The transducer of claim 1, wherein said preselected acoustic frequency is the resonant frequency of said transducer.

3. The transducer of claim 1, wherein said transducer comprises a water tight sealant surrounding said plates.

4. An electro-acoustic transducer capable of being driven in a piston mode comprising:

a plurality of cymbal-shaped acoustic elements; and a pair of plates;

wherein each of said plurality of cymbal-shaped acoustic elements is disposed in a mechanical parallel arrangement between said pair of plates, and each of said cymbal-shaped elements is further disposed in electric parallel arrangement with respect to one another, whereby when said electro-acoustic transducer is driven in a piston mode said plates experience an up and down motion in a linear fashion, resulting in a near field velocity that is substantially linear.

5. The transducer of claim 4, wherein said each of said plurality of cymbal-shaped acoustic elements is a stack of cymbal-shaped acoustic elements disposed in mechanical series arrangements with one another.

6. The transducer of claim 4, wherein said transducer comprises a water tight sealant surrounding said plates.

* * * * *